United States Patent [19]

Yamagami et al.

[11] Patent Number: 4,568,635

[45] Date of Patent: Feb. 4, 1986

[54] SILVER HALIDE LIGHT-SENSITIVE MATERIAL

[75] Inventors: Hiroyuki Yamagami; Kazunori Hasebe; Naoyasu Deguchi; Koki Nakamura; Hiroyuki Mifune, all of Kanagawa, Japan

[73] Assignee: Fuji Photo Film Co., Ltd., Kanagawa, Japan

[21] Appl. No.: 574,437

[22] Filed: Jan. 27, 1984

[30] Foreign Application Priority Data

Jan. 28, 1983 [JP] Japan ..... 58-12277

[51] Int. Cl.[4] ..... G03C 1/30

[52] U.S. Cl. ..... 430/505; 430/569; 430/622; 430/611; 430/377

[58] Field of Search ..... 430/622, 611, 569, 505, 430/377

[56] References Cited

U.S. PATENT DOCUMENTS

| | | | |
|---|---|---|---|
| 3,490,911 | 1/1970 | Burness et al. | 430/621 |
| 4,221,863 | 9/1980 | Overman et al. | 430/569 |
| 4,284,717 | 8/1981 | Toya et al. | 430/569 |

*Primary Examiner*—Won H. Louie

*Attorney, Agent, or Firm*—Sughrue, Mion, Zinn, Macpeak and Seas

[57] ABSTRACT

A silver halide light-sensitive material comprising a support having provided thereon at least one silver halide emulsion layer is disclosed. The emulsion layer contains a silver halide prepared in the presence of a tetrasubstituted thiourea as a silver halide solvent and was hardened with a hardener containing a vinylsulfonyl group. Combined use of the tetrasubstituted thiourea and the hardener of the above-described kinds increases the storability of the light-sensitive material.

21 Claims, No Drawings

SILVER HALIDE LIGHT-SENSITIVE MATERIAL

FIELD OF THE INVENTION

The present invention relates to a silver halide light-sensitive material and, more particularly, to a silver halide light-sensitive material which does not decrease in sensitivity and further which will not undergo an increase in its fog density or a fading of the latent image formed therein, even after being stored for long periods of time.

BACKGROUND OF THE INVENTION

Coated layers which constitute a silver halide light-sensitive material contain, in numerous cases, gelatin as a binder. The gelatin is cross-linked with a substance called a hardener for the purpose of heightening the mechanical and chemical strengths of the coated layers.

Various kinds of compounds are used as such hardeners including hardeners having a vinylsulfonyl group as described in German Published Application No. 1,100,942; U.S. Pat. Nos. 3,490,911 and 3,539,644; Japanese Patent Application (OPI) Nos. 74832/73, 24435/74 and 41221/89; etc., which have been considered best suitable for using as a rapid hardener. (The term "OPI" as used herein refers to a "published unexamined Japanese patent application.)

However, compared with prevailingly used hardeners of the active chloro group-containing triazine type, the above-described hardeners containing a vinylsulfonyl group suffer from the defect that deterioration of the stability of the resulting products is caused upon long-range storage, and an increase in the fog density and a lowering of the sensitivity are brought about in those products when kept under high temperature and/or high humidity.

SUMMARY OF THE INVENTION

Therefore, an object of the present invention is to make an improvement in the long-range storability of a silver halide light-sensitive material in which a vinylsulfonyl group-containing hardener is used.

In order to accomplish the above-described object, the present inventors have carried out various investigations and found that a silver halide emulsion prepared in the presence of a tetrasubstituted thiourea as a silver halide solvent hardly suffers any deterioration in its stability upon long-range storage even if a vinylsulfonyl group-containing hardener is employed therein, and fading of the latent image (a phenomenon whereby the latent image decays during the period from exposure to photographic processing) is also reduced in degree by this combination.

DETAILED DESCRIPTION OF THE INVENTION

Although silver halide solvents are known to be capable of increasing the grain size of silver halide grains formed and narrowing the grain size distribution thereof, they have not yet been known to be capable of preventing deterioration in the long-range storability of the sensitive material caused by the incorporation of a vinylsulfonyl group-containing hardener.

The present inventors also unexpectedly found that sufficient effects with respect to the prevention of deterioration in storability are brought only when tetrasubstituted thioureas are employed as a silver halide solvent. The use of other silver halide solvents, such as ammonia and organic thioethers described in Japanese Patent Application (OPI) Nos. 11386/72, have no effect thereon. Moreover, although tetrasubstituted thioureas are known to function as a silver halide solvent in, for example, Japanese Patent Application (OPI) Nos. 82408/78 and 77737/80; U.S. Pat. No. 4,221,863; and so on, the combined use with a vinylsulfonyl group-containing hardener is not pointed out specifically in those specifications. Therefore, the effect of the present invention is unforeseen from the above-described known cases.

The present invention comprises a silver halide light-sensitive material comprising a support having provided thereon at least one silver halide emulsion layer hardened with a vinylsulfonyl group-containing hardener, the emulsion layer containing a silver halide prepared in the presence of a tetrasubstituted thiourea as a silver halide solvent.

Preferable examples of tetrasubstituted thiourea as silver halide solvent which can be employed in the present invention include compounds represented by the following general formula (I) as described in Japanese Patent Application (OPI) Nos. 82408/78 and 77737/80, and so on, which are a tetra-substituted thiourea and contains at least one amino group or nitrogen-containing heterocyclic ring:

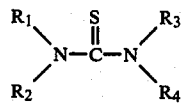

(I)

wherein $R_1$, $R_2$, $R_3$ and $R_4$ each represents a substituted or unsubstituted alkyl group (the alkyl moiety has preferably 1 to 5 carbon atoms, e.g., methyl group or ethyl group), a substituted or unsubstituted alkenyl group having 3 to 8 carbon atoms (e.g., allyl group), a substituted or unsubstituted aryl group having 6 to 8 carbon atoms (e.g., phenyl group or tolyl group), or a substituted or unsubstituted nitrogen-containing heterocyclic ring; $R_1$, $R_2$, $R_3$ and $R_4$ may be the same or different and contain a total of up to 30 carbon atoms; $R_1$ and $R_2$, $R_2$ and $R_3$, or $R_3$ and $R_4$ when taken together may form a 5- or 6-membered nitrogen-containing heterocyclic ring, e.g., an imidazolidinethione, a piperidine, a piperazine, a morpholine or a pyrrolidine group, which nitrogen-containing heterocyclic ring may be substituted with, for example, an alkyl group (having preferably 1 to 5 carbon atoms, e.g., methyl group), a hydroxyl group or a carboxyl group.

The above defined alkyl group may be straight or branched. It may be substituted with, for example, a hydroxyl group, a carboxyl group, a sulfonic group, an amino group (e.g., a monoalkylamino group or a dialkylamino group containing 1 to 3 carbon atoms in the alkyl moiety and preferably a dialkylamino group), an alkoxy group wherein the alkyl residue has 1 to 5 carbon atoms, a phenyl group or a 5- or 6-membered nitrogen-containing heterocyclic ring (e.g., pyridine, imidazole or pyrazine).

The aryl group may be substituted with, for example, a hydroxyl group, a carboxyl group, a sulfonic acid group or an amino group (preferably a dialkylamino group).

The alkenyl group has preferably a total of 3 to 7 carbon atoms. The alkenyl group may be substituted with, for example, a hydroxyl group, a carboxyl group or a sulfonic group.

The nitrogen-containing heterocyclic ring represented by $R_1$, $R_2$, $R_3$ or $R_4$ is preferably saturated and may contain an oxygen atom and/or a sulfur atom in addition to the nitrogen atom. The nitrogen-containing heterocyclic ring may bear a substituent such as an alkyl group (having 1 to 5 carbon atoms in the alkyl moiety, e.g., methyl group). Illustrative examples of the nitrogen-containing heterocyclic ring include a pyridine ring (e.g., 2-pyridine or 4-pyridine), a thiazole ring (e.g., 2-thiazole), an imidazole ring (e.g., 2-imidazole), a pyrazine ring (e.g., 2-pyrazine), and a 1,2,4-triazole ring (e.g., a 3-(1,2,4-triazole)).

The compound used in this invention is such that at least one or $R_1$ to $R_4$ of the formula (I) is a 5- or 6-membered nitrogen-containing heterocyclic ring, an alkyl or aryl group substituted with an amino group, an alkyl group substituted with a nitrogen-containing heterocyclic ring, or $R_1$ and $R_2$, $R_2$ and $R_3$, or $R_3$ and $R_4$ combine to form a 5- or 6-membered nitrogen-containing heterocyclic ring containing at least 2 nitrogen atoms. Examples of such compounds include salts thereof with mineral acid such as hydrochloric acid or salts thereof with organic acids such as acetic acid.

In the formula (I), it is preferred that $R_1$ to $R_4$ have a total of 20 carbon atoms or less. The substituent amino group is preferably a tertiary amino group (e.g., a dimethylamino group, or diethylamino group). Particularly preferred compounds are ones in which at least one of $R_1$ and $R_2$ and $R_3$ and $R_4$ combined to form a ring.

Examples of the compound that can be used in this invention include the following:

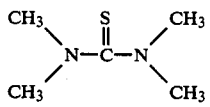
I-1

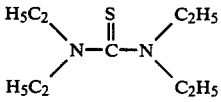
I-2

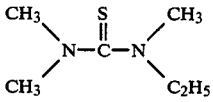
I-3

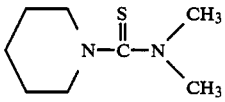
I-4

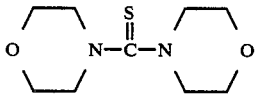
I-5

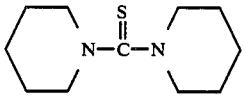
I-6

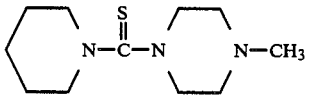
I-7

-continued

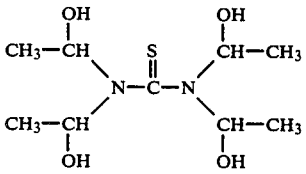
I-8

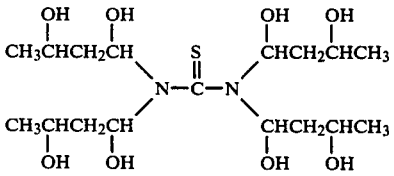
I-9

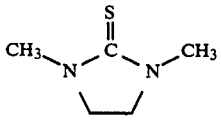
I-10

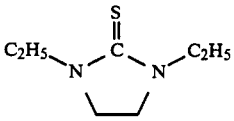
I-11

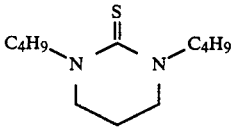
I-12

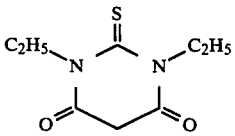
I-13

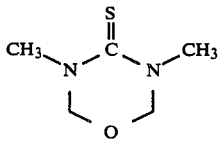
I-14

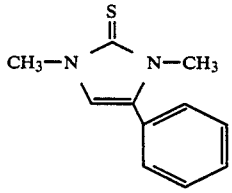
I-15

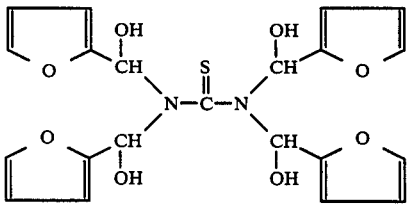
I-16

For details of the syntheses of these compounds descriptions in Japanese Patent Application (OPI) Nos. 82408/78 and 77737/80 can be referred to.

The tetrasubstituted thiourea as silver halide solvent may be added to the system for preparing the silver halide at any stage in the preparation where the size and the shape of the silver halide grains have not yet reached the size and shape desired.

The above-described solvent may be added to, for example, a colloidal material in which the silver halide is to be precipitated. Alternatively, the solvent and either of the water-soluble silver salt (e.g., silver nitrate) or the water-soluble halide (e.g., potassium bromide, sodium chloride and other alkali metal halides), which are employed for the preparation of the silver halide, may be added in combination. Moreover, the solvent may be added prior to or during the physical ripening of the silver halide. Furthermore, the solvent may be added in one or more steps during the process of preparing the silver halide emulsion.

In a preferred embodiment of the present invention, the tetrasubstituted thiourea of the formula (I) is added prior to the physical ripening of the silver halide produced.

The emulsions of the present invention can be prepared using various methods, as described in, for example, P. Glafkides, *Chimie et Physique Photographique,* Paul Montel, Paris (1957); G. F. Duffin, *Photographic Emulsion Chemistry,* The Focal Press, London (1966); and V. L. Zelikman et al, *Making and Coating Photographic Emulsion,* The Focal Press, London (1964).

Suitable methods for reacting a water-soluble silver salt with a water-soluble halide include, e.g., a single jet method, a double jet method and a combination thereof.

Also, a method in which silver halide grains are produced in the presence of excess silver ion (the so-called reversal mixing method) can be employed in the present invention. In addition, the so-called controlled double jet method, wherein the pAg of the liquid phase in which silver halide grains are to be precipitated is maintained constant, may also be employed herein.

The silver halide emulsions of the present invention are, in general, prepared under conditions of a temperature ranging from about 30° C. to 90° C., a pH of about 9 or less, preferably not higher than 8, and a pAg of about 10 or less.

In a process of producing silver halide grains or allowing the produced silver halide grains to physically ripen, cadmium salts, zinc salts, lead salts, thallium salts, iridium salts or complexes thereof, rhodium salts or complexes thereof, iron salts or complexes thereof, and the like may be present.

Examples of silver halides which may be present in the silver halide emulsions of the present invention include silver bromide, silver iodide, silver chloride, silver chlorobromide, silver bromoiodide, silver chlorobromoiodide and so on. Preferred silver halide emulsions are comprised of silver halide grains in which the halide composition of the silver halide is at least 50 mole % bromide and more particularly, those containing about 10 mole percent iodide or less and the remainder bromide.

A suitable mean diameter of the silver halide grains ranges from 0.2 to 4 microns. Particularly, silver halide grains having a mean grain diameter of about 0.25 to 2 microns provide good results. The grain size distribution may be either narrow or broad. The mean diameter of the grains can be measured using conventional techniques as described in, for example, *The Photographic Journal,* volume 79, page 330–338 (1939).

The silver halide grains in the photographic emulsions of the present invention may have a regular crystal form, such as that of a cube or an octahedron; an irregular crystal form, such as that of a sphere, a plate or so on; or a composite form thereof. A mixture of various crystal forms of silver halide grains may also be present.

The interior and the surface of the silver halide grains may differ, or the silver halide grains may be uniform throughout. Further, either silver halide grains of the kind which predominantly form a latent image at the surface of the grains, or grains of the kind which mainly form a latent image inside the grains can be used.

The addition amount of the above-described tetrasubstituted thiourea as silver halide solvent to be employed in the present invention can be varied over a wide range depending upon the desired extent the effect the silver halide solvent should obtain, the kind of a tetrasubstituted thiourea used, and so on. In general, a suitable addition amount ranges from about $1\times10^{-5}$ to $5\times10^{-2}$ mole of the tetrasubstituted thiourea per mole of the silver halide. Especially good results are obtained when the tetrasubstituted thiourea of the present invention is employed in the range of about $1\times10^{-4}$ to $2.5\times10^{-2}$ mole per mole of the silver halide. The tetrasubstituted thiourea as silver halide solvent of the present invention may be used together with other conventional silver halide solvents such as ammonia, organic thioethers and so on. From the silver halide emulsion of the present invention, soluble salts are, in general, removed after the formation of the silver halide or after physical ripening thereof. The removal can be effected using the noodle washing method known from old times which comprises gelling the gelatin, or using a sedimentation process (thereby causing flocculation in the emulsion) taking advantage of a sedimenting agent such as a polyvalent anion-containing inorganic salt (e.g., sodium sulfate), an anionic surface active agent, an anionic polymer (e.g., polystyrenesulfonic acid), or a gelatin derivative (e.g., an aliphatic acylated gelatin, an aromatic acylated gelatin, an aromatic carbamoylated gelatin or the like). Preferred sedimenting processes for this purpose are disclosed in, for example, U.S. Pat. Nos. 2,614,928, 2,618,556, 2,565,418 and 2,489,341, and so on. The removal of soluble salts from the silver halide emulsion may be omitted.

The silver halide emulsion of the present invention is chemically sensitized. Chemical sensitization can be carried out using processes described in P. Glafkides, supra, V. L. Zelikman et al, supra, or H. Frieser *Die Grundlagen der Photographischen Prozesse mit Silberhalogeniden,* Akademische Verlagsgesellschaft (1968).

More specifically, sulfur sensitization using compounds containing sulfur capable of reacting with silver ion or active gelatin, reduction sensitization using reducing materials, sensitization with gold or other noble metal compounds and so on can be employed individually or as a combination thereof. Examples of suitable sulfur sensitizers which can be used include thiosulfates, thioureas, thiazoles, rhodanines and other sulfur-containing compounds. Specific examples of these sulfur sensitizers are disclosed in U.S. Pat. Nos. 1,574,944, 2,410,689, 2,278,947, 2,728,668 and 3,656,955. Examples of reducing sensitizers include stannous salts, amines, hydrazine derivatives, formamidine sulfinic acid, silane compounds and so on. Specific examples of these sensitizers are described in U.S. Pat. Nos. 2,487,850, 2,419,974, 2,518,698, 2,983,609, 2,983,610 and 2,694,637. Group VIII metal complexes such as those of platinum, iridium, palladium, etc. in addition to gold metal complexes can be employed for the purpose of sensitization with a noble metal. Specific examples of these metal complexes are disclosed in U.S. Pat. Nos. 2,399,083 and 2,448,060; British Pat. No. 618,061; and so on.

The photographic emulsion of the present invention is hardened with a hardener containing a vinylsulfonyl group. Examples of such a hardener include, as described hereinbefore, the compounds disclosed in German Published Application No. 1,100,942; U.S. Pat. Nos. 3,490,911 and 3,539,644; and Japanese Patent Application (OPI) Nos. 74832/74, 24435/74 and 41221/78. Among those compounds, those having the general formula (II) are of greater advantage:

$$(CH_2{=}CH{-}SO_2{-}\underset{\underset{R}{|}}{CH})_2A \qquad \text{(II)}$$

wherein R represents a hydrogen atom or a lower alkyl group (e.g., one having 1 to 4 carbon atoms); and A represents a divalent group which is optionally present.

Specific examples of the hardeners of the formula (II) which can be effectively used in the practice of the present invention are set forth below.

$$CH_2{=}CH{-}SO_2{-}CH_2{-}CH_2{-}O{-}CH_2{-}CH_2{-}SO_2{-}CH{=}CH_2 \qquad \text{(II-1)}$$

$$CH_2{=}CH{-}SO_2{-}CH_2{-}O{-}CH_2{-}SO_2{-}CH{=}CH_2 \qquad \text{(II-2)}$$

$$CH_2{=}CH{-}SO_2{-}\underset{\underset{C_2H_5}{|}}{CH}{-}O{-}\underset{\underset{C_2H_5}{|}}{CH}{-}SO_2{-}CH{=}CH_2 \qquad \text{(II-3)}$$

$$CH_2{=}CH{-}SO_2{-}CH_2{-}CH_2{-}NH{-}CH_2{-}CH_2{-}SO_2{-}CH{=}CH_2 \qquad \text{(II-4)}$$

$$CH_2{=}CH{-}SO_2{-}CH_2CONHCH_2{-}CH_2NHCOCH_2{-}SO_2{-}CH{=}CH_2 \qquad \text{(II-5)}$$

$$CH_2{=}CH{-}SO_2{-}CH_2CONHCH_2{-}CH_2{-}CH_2NHCOCH_2{-}SO_2{-}CH{=}CH_2 \qquad \text{(II-6)}$$

$$CH_2{=}CH{-}SO_2{-}CH_2{-}CONH{-}NHCO{-}CH_2{-}SO_2{-}CH{=}CH_2 \qquad \text{(II-7)}$$

$$CH_2{=}CH{-}SO_2{-}CH_2{-}CON\underset{\underset{CH_3}{|}}{}{-}CH_2{-}CH_2{-}N\underset{\underset{CH_3}{|}}{}CO{-}CH_2{-}SO_2{-}CH{=}CH_2 \qquad \text{(II-8)}$$

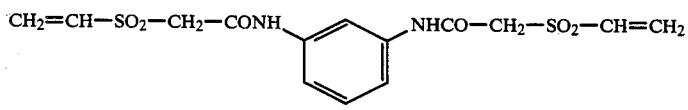

(II-9)

$$CH_2{=}CH{-}SO_2{-}CH_2{-}CONH{-}(CH_2)_4{-}NHCO{-}CH_2{-}SO_2{-}CH{=}CH_2 \qquad \text{(II-10)}$$

$$CH_2CH{-}SO_2{-}CH_2{-}\underset{\underset{OH}{|}}{CH}{-}CH_2{-}SO_2{-}CH{=}CH_2 \qquad \text{(II-11)}$$

$$CH_2{=}CH{-}SO_2{-}CH_2{-}CH_2{-}CH_2{-}SO_2{-}CH{=}CH_2 \qquad \text{(II-12)}$$

Syntheses of these compounds may be carried out by reference to the methods described in the foregoing patents, e.g., Japanese Patent Application (OPI) Nos. 41221/78 and U.S. Pat. No. 3,539,644.

The hardener containing a vinylsulfonyl group may be added to the above-described coating composition of a silver halide emulsion. On the other hand, it may first be added to a coating composition for another hydrophilic colloid layer and then, it allowed to diffuse into a silver halide emulsion layer at the time of coating. An addition amount of this hardener can be arbitrarily chosen as far as it answers the purpose. In general, it is used in a proportion of 0.1 to 10 wt%, preferably 0.5 to 5 wt%, based on the weight of dried gelatin.

The use of gelatin as a binder or a protective colloid for a photographic emulsion is advantageous. Of course, hydrophilic colloids other than gelatin may be also used for such a purpose as described above.

Suitable examples of hydrophilic colloids which can be used as a binder or a protective colloid for a photographic emulsion include proteins such as gelatin derivatives, those obtained by graft polymerization of gelatin and other high polymers, albumin, casein, etc.; sugar derivatives such as cellulose derivatives including hydroxyethyl cellulose, carboxymethyl cellulose, cellulose sulfate and the like, sodium alginate, starch derivatives, etc.; and various kinds of synthetic hydrophilic high polymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, and other like homo- or co-polymers.

Gelatin which can be employed includes not only lime-processed gelatin, but also acid-processed gelatin and enzyme-processed gelatin as described in *Bull. Soc. Sci. Phot. Japan,* No. 16, p. 30 (1966). Further, hydrolysis products of gelatin and enzymatic degradation products of gelatin can also be employed.

The silver halide emulsions of the present invention can contain a wide variety of compounds for purposes of preventing fogging or stabilizing photographic functions during production, storage or processing of the photosensitive material. Namely azoles such as benzothiazolium salts, nitroindazoles, triazoles, benzotriazoles, benzimidazoles (especially, nitro- or halogen-substituted ones), etc.; heterocyclic mercapto compounds such as mercaptothiazoles, mercaptobenzothiazoles, mercaptobenzimidazoles, mercaptothiadiazoles, mercaptotetrazoles (especially, 1-phenyl-5-mercaptotetrazole), mercaptopyrimidines, etc.; the above-described heterocyclic mercapto compounds containing water-soluble groups such as carboxyl group, sulfonyl group, or the like; thioketone compounds like oxazolinethione; azaindenes such as tetrazaindenes (especially, 4-hydroxy-substituted-(1,3,3a,7)-tetrazaindenes); benzenethiosulfonic acids; benzenesulfinic acid; and other many compounds known as an antifoggant or a stabilizer can be added to the silver halide emulsions of the present invention.

The hydrophilic colloid layers of the photosensitive material of the present invention may contain various kinds of surface active agents for a wide variety of purposes, for example, as a coating aid, prevention from the generation of static charges, improvement in the slipping property, emulsifying dispersion, prevention from the generation of adhesion, improvement in the photographic characteristics (e.g., development acceleration, contrast heightening, sensitization, etc.) and so on.

Examples of suitable surface active agents include nonionic surface active agents such as saponin (of steroid type), alkylene oxide derivatives (e.g., polyethylene glycol, polyethylene glycol-polypropylene glycol condensate, polyethylene glycol alkyl ethers, polyethylene glycol alkylaryl ethers, polyethylene glycol esters, polyethylene glycol sorbitan esters, polyalkylene glycol alkylamines or amides, polyethylene oxide adducts of silicone, etc.), glycidol derivatives (e.g., alkenylsuccinic acid polyglycerides, alkylphenol polyglycerides, etc.), fatty acid esters of polyhydric alcohols, alkyl esters of sugar, and so on; anionic surface active agents containing acidic groups such as a carboxyl group, a sulfonic group, a phosphoric group, a sulfate group, a phosphate group, etc., e.g., alkyl carboxylates, alkyl sulfonates, alkylbenzene sulfonates, alkylnaphthalene sulfonates, alkylsulfuric acid esters, alkylphosphoric acid esters, N-acyl-N-alkyltaurines, sulfosuccinic acid esters, sulfoalkylpolyoxyethylene alkylphenyl ethers, polyoxyethylene alkylphosphoric acid esters, or so on; amphoteric surface active agents such as amino acids, aminoalkylsulfonic acids, aminoalkylsulfates or aminoalkylphosphates, alkylbetaines, amine oxides, etc.; and cationic surface active agents such as alkylamine salts, aliphatic or aromatic quaternary ammonium salts, heterocyclic quaternary ammonium salts like pyridinium, imidazolium, etc., aliphatic or heterocyclyl phosphonium or sulfonium salts, and so on.

In the photographic emulsions of the present invention, in order to increase the sensitivity and the contrast, or accelerate the developing speed, for example, polyalkylene oxides or their derivatives (e.g., ethers, esters and amines of polyalkylene oxides); thioether compounds; thiomorpholines; quaternary ammonium salts; urethane derivatives; urea derivatives; imidazole derivatives; 3-pyrazolidones; and so on can be incorporated. More specifically, those described in U.S. Pat. Nos. 2,400,532, 2,423,549, 2,716,062, 3,617,280, 3,772,021 and 3,808,003; British Pat. No. 1,488,991; and so on can be employed.

The emulsion layers and other hydrophilic colloid layers of the light-sensitive material of the present invention can contain dispersions of water-insoluble or slightly water-soluble synthetic polymers for the purposes of improvement in the dimensional stability and so on. For example, homo- or copolymers prepared using as monomer components alkyl(metha)crylates, alkoxyalkyl(metha)crylates, glycidyl(metha)crylate, (metha)crylamide, vinyl esters (e.g., vinyl acetate, etc.), acrylonitrile, olefins, styrene or so on individually or in combination of two or more thereof; and copolymers prepared using as monomer components combinations of one or more of the above-described monomers with one or more of monomers selected from the group consisting of acrylic acid, methacrylic acid, $\alpha,\beta$-unsaturated dicarboxylic acids, hydroxyalkyl(metha)crylates, sulfoalkyl(metha)crylates, styrenesulfonic acid and so on can be employed. More specifically, those described in U.S. Pat. Nos. 2,376,005, 2,739,137, 2,853,457, 3,062,674, 3,411,911, 3,488,708, 3,525,620, 3,607,290, 3,635,715 and 3,645,740; and British Pat. Nos. 1,186,699 and 1,307,373 can be employed.

The photographic emulsions of the present invention may be spectrally sensitized using methine dyes or other dyes. These sensitizing dyes may be employed individually or in combination. Combinations of sensitizing dyes are often employed for the purpose of supersensitization. In addition, materials which can exhibit a supersensitization effect in combination with a certain sensitizing dye although they themselves do not spectrally sensitize silver halide emulsions or do not absorb light in the visible region may be incorporated in the silver halide emulsion.

Useful examples of sensitizing dyes, supersensitizing combinations of dyes, and materials which can exhibit a supersensitization effect are described in *Research Disclosure,* vol. 176, 17643 (Dec., 1978), page 23, J-paragraph.

The emulsion layers and other hydrophilic colloid layers to be employed in the present invention are coated on a flexible support such as a plastic film, paper, cloth or the like, or a rigid support such as glass, earthenware, metal or the like. More specifically, useful examples of flexible supports include films made up of semi-synthetic or synthetic polymers such as cellulose nitrate, cellulose acetate, cellulose acetate butyrate, polystyrene, polyvinyl chloride, polyethylene terephthalate, polycarbonate, etc.; and papers coated or laminated with a baryta layer, an $\alpha$-olefin polymer (e.g., polyethylene, polypropylene, ethylenebutene copolymer, etc.) or so on. The support may be colored with a dye or a pigment. It may be made black for the purpose of light shielding. On one side of the support, a subbing layer is, in general, coated in order to improve adhesiveness to a photographic emulsion layer. The support surface may be subjected to corona discharge, ultraviolet irradiation, flame processing and so on before or after the coating of the subbing layer.

The coating can be carried out using a dip coating process, a roller coating process, a curtain coating process, an extrusion coating process and so on. Of these processes, those described in U.S. Pat. Nos. 2,681,294, 2,761,791 and 3,526,528 are of greater advantage.

The present invention can also be applied to multilayer multicolor photographic materials having at least two emulsion layers differing in spectral sensitivity. In general, a multilayer color photographic material has on a support at least one red-sensitive emulsion layer, at least one green-sensitive layer and at least one blue-sensitive emulsion layer. The order of coating these layers can be arbitrarily chosen based on needs. For general purposes, the red-sensitive emulsion layer contains a cyan color forming coupler, the green-sensitive emulsion layer contains a magenta color forming coupler, and the blue-sensitive emulsion layer contains a yellow color forming coupler. However, other combinations can be employed under certain circumstances.

The photographic emulsion of the light-sensitive material of the present invention may contain color forming couplers, that is, compounds capable of forming colors by the oxidative coupling reaction with aromatic primary amine developers (e.g., phenylenediamine derivatives, aminophenol derivatives, etc.) in the color development-processing. Examples of magenta couplers which may be present include 5-pyrazolone type couplers, pyrazolobenzimidazole type couplers, cyanoacetylcumarone type couplers, open-chain acylacetonitrile type couplers and so on. Examples of the yellow coupler which may be present include acylacetamide type couplers (such as benzoylacetanilides, pivaloylacetanilides and the like) and so on. Examples of useful cyan coupler include naphthol type couplers, phenol type couplers and so on. These couplers preferably include a hydrophobic group called a ballast group in their individual molecules and thereby, acquire non-diffusibility. These couplers may be either four equivalent or two equivalent with respect to silver ions. In addition, colored couplers having a color compensating effect, or couplers capable of releasing development inhibitors in proportions as development proceeds (so-called DIR couplers) may be contained. Further, colorless DIR coupling compounds which provide colorless products upon the coupling reaction and which can release development inhibitors may also be contained in addition to DIR couplers.

Specific examples of magenta color forming couplers include those described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445; West German Pat. No. 1,810,464; West German Patent Application (OLS) Nos. 2,408,665, 2,417,945, 2,418,959 and 2,424,467; Japanese Patent Publication Nos. 6031/65, 58922/77, 129538/74, 74027/74, 159336/75, 42121/77, 74028/74, 60233/75, 26541/76 and 55122/78; and so on.

Specific examples of yellow color forming couplers include those described in U.S. Pat. Nos. 2,875,057, 3,265,506, 3,408,194, 3,551,155, 3,582,322, 3,725,072 and 3,891,445; West German Pat. No. 1,547,868; West German Patent Application (OLS) Nos. 2,219,917, 2,261,361 and 2,414,006; British Pat. No. 1,425,020; Japanese Patent Publication No. 10783/76; Japanese Patent Application (OPI) Nos. 26133/72, 73147/73, 102636/76, 6341/75, 123342/75, 130442/75, 21827/76, 87650/75, 82424/77 and 115219/77; and so on.

Specific examples of cyan color forming couplers include those described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929; West German Patent Application (OLS) Nos. 2,414,830 and 2,454,329; and Japanese Patent Application (OPI) Nos. 59838/73, 26034/76, 5055/73, 146828/76, 69624/77 and 90932/77.

Specific examples of colored couplers which can be used include those described in U.S. Pat. No. 3,476,560; Japanese Patent Publication Nos. 2016/69, 22335/63, 11304/67 and 32461/69; Japanese Patent Application (OPI) Nos. 26034/76 and 42121/77; West German Patent Application (OLS) No. 2,418,959; and so on.

Specific examples of DIR couplers include those described in U.S. Pat. Nos. 3,227,554, 3,617,291, 3,701,783, 3,790,384 and 3,632,345; West German Patent Application (OLS) Nos. 2,414,006, 2,454,301 and 2,454,329; British Pat. No. 953,454; Japanese Patent Application (OPI) Nos. 69624/77 and 122335/74; and Japense Patent Publication No. 16141/76.

Besides containing the DIR couplers, the light-sensitive material of the present invention may contain a compound capable of releasing a development inhibitor in proportion as development proceeds, and specific examples of such a compound which can be employed herein include those described in U.S. Pat. Nos. 3,297,445 and 3,379,529; West German Patent Application (OLS) No. 2,417,914; and Japanese Patent Application (OPI) Nos. 15271/77 and 9116/78.

Incorporation of these couplers into silver halide emulsion layers can be carried out using known methods, e.g., those described in U.S. Pat. No. 2,322,027. Specifically, they are first dissolved in high boiling point organic solvents, such as phthalic acid alkyl esters (e.g., dibutyl phthalate, dioctyl phthalate, etc.), phosphoric acid esters (e.g., diphenyl phosphate, triphenyl phosphate, tricresyl phosphate, dioctylbutyl phosphate, etc.), citirc acid esters (e.g., tributyl acetylcitrate), benzoic acid esters (e.g., octyl benzoate), alkylamides (e.g., diethyllaurylamide), fatty acid esters (e.g., dibutoxyethyl succinate, dioctyl azelate, etc.), trimesic acid esters (e.g., tributyl trimesate) and so on, or organic solvents having a boiling point ranging from about 30° C. to 150° C., such as lower alkyl acetates (e.g., ethyl acetate, butyl acetate, etc.), ethyl propionate, secondary butyl alcohol, methyl isobutyl ketone, β-ethoxyethyl acetate, methyl cellosolve acetate, etc. and then, dispersed into hydrophilic colloids. The above-described high boiling point organic solvents may be used in combination with low boiling point organic solvents.

Further, the dispersing process utilizing polymers described in Japaense Patent Publication No. 39853/76 and Japanese Patent Application (OPI) No. 59943/76 can be also employed.

Couplers having an acid group such as a carboxyl group, a sulfonic group or the like are introduced into hydrophilic colloids in the form of an alkaline aqueous solution.

In the light-sensitive material of the present invention, the photographic emulsion layers and other hydrophilic colloid layers may contain brightening agents of the stilbene type, triazine type, oxazole type, coumarin type or so on. Such an agent may be either water-soluble or water-insoluble. Water-insoluble brightening agents may be used in a form of dispersion.

Specific examples of brightening agents which can be employed include those described in U.S. Pat. Nos. 2,632,701, 3,269,840 and 3,359,102; British Pat. Nos. 852,075 and 1,319,763; *Research Disclosure, No.* 17643, p. 24, left column, lines 9–36, title Brighteners (Dec., 1978), and so on.

In the light-sensitive material of the present invention, dyes, ultraviolet absorbing agents and the like which are incorporated in a hydrophilic colloid layer may be mordanted with cationic polymers or the like. Specifically, polymers as described in British Pat. No. 685,475; U.S. Pat. Nos. 2,675,316, 2,839,401, 2,882,156, 3,048,487, 3,184,309 and 3,445,231; West German Patent Application (OLS) No. 1,914,362; Japanese Patent Application (OPI) Nos. 47624/75 and 71332/75; and so on can be employed for the above-described purpose.

The light-sensitive material of the present invention may contain a hydroquinone derivative, an aminophenol derivative, a gallic acid derivative, an ascorbic aid derivative or the like as a color fog inhibitor.

Specific examples of the color fog inhibitor are described in U.S. Pat. Nos. 2,360,290, 2,336,327, 2,403,721, 2,418,613, 2,675,314, 2,701,197, 2,704,713, 2,728,659, 2,732,300 and 2,735,365; Japanese Patent Application (OPI) Nos. 92988/75, 92989/75, 93928/75, 110337/75 and 146235/77; and Japanese Patent Publication No. 23813/75.

The light-sensitive material of the present invention may contain an ultraviolet absorbing agent in its hydrophilic colloidal layer. For example, benzotriazole compounds substituted with aryl groups, 4-thiazolidone compounds, benzophenone compounds, cinnamic acid ester compounds, butadiene compounds, benzoxazole compounds and further, ultraviolet absorbing polymers can be employed. These ultraviolet absorbing agents may be fixed in the above-described hydrophilic colloid layer.

Specific examples of these ultraviolet absorbing agents are described in U.S. Pat. Nos. 3,533,794, 3,314,794 and 3,352,681; Japanese Patent Application (OPI) No. 2784/71; U.S. Pat. Nos. 3,705,805, 3,707,375, 4,045,229, 3,700,455 and 3,499,762; West German Published Application No. 1,547,863; and so on.

The light-sensitive material of the present invention may contain water-soluble dyes in its hydrophilic colloid layers as a filter dye, as an anti-halation dye or for other various purposes. Suitable examples of such dyes include oxonol dyes, hemioxonol dyes, styryl dyes, merocyanine dyes, cyanine dyes and azo dyes. Of these dyes, oxonol dyes, hemioxonol dyes and merocyanine dyes are useful for the above-described purposes.

In practicizing the present invention, known discoloration inhibitors as described below can be employed and further, the color image stabilizers to be employed in the present invention can be used either individually or in combination of two or more thereof. Known discoloration inhibitors include hydroquinone derivatives, gallic acid derivatives, p-alkoxyphenols, p-oxyphenol derivatives, bisphenols and the like.

Specific examples of the hydroquinone derivative include those described in U.S. Pat. Nos. 2,360,290, 2,418,613, 2,675,314, 2,701,197, 2,704,713, 2,728,659, 2,732,300, 2,735,765, 2,710,801 and 2,816,028; British Pat. No. 1,363,921; and so on. Those of the gallic acid derivatives are described in U.S. Pat. Nos. 3,457,079 and 3,069,262; and so on, those of the p-alkoxyphenols are described in U.S. Pat. Nos. 2,735,765 and 3,698,909; and Japanese Patent Publication Nos. 20977/74 and 6623/77, those of the p-oxyphenol derivatives are described in U.S. Pat. Nos. 3,432,300, 3,573,050, 3,574,627 and 3,764,337; and Japanese Patent Application (OPI) Nos. 35633/77, 147434/77 and 152225/77, and those of the bisphenols are described in U.S. Pat. No. 3,700,455.

The exposure for obtaining a photographic image may be carried out in a conventional manner. Any various known light sources including natural light (sunlight), a tungsten lamp, a fluorescent lamp, a mercury lamp, a xenon arc lamp, a carbon arc lamp, a xenon flash lamp, cathode-ray tube flying spot and so on can be employed for the exposure. Suitable exposure times which can be used inlcude not only exposure times commonly used in cameras ranging from 1/1000 to 1 sec., but also exposure times shorter than 1/1000 sec., for example, $1/10^4$ to $1/10^6$ sec. as used with xenon flash lamps and cathode-ray tubes. Exposure times longer than 1 second can also be used. The spectral distribution of the light employed for the exposure can be controlled using color filters, if desired. Laser beams can be also employed for the exposure. Moreover, the light-sensitive material of the present invention may also be exposed to light emitted from phosphors excited by electron beams, X-rays, $\gamma$-rays, $\alpha$-rays and the like.

The light-sensitive material prepared in accordance with the present invention can contain a so-called gaseous fog inhibitor for the purpose of preventing the deterioration of photographic properties (e.g., a decrease in coloration density, an increase in color stain, an increase in fog, etc.) from being caused by the presence of harmful gases such as formaldehyde gas, etc. For example, amines (including alkylamines, arylamines and heterocyclic amines), amides, cyclic and acyclic ureas, sulfinic acids, imides, active methylenes, hydroxybenzenes, sulfites and so on can be used for the above-described purpose.

Specific examples of the gaseous fog inhibitor which can be used include those described in Japanese Patent Publication Nos. 34675/71, 38418/73 and 23908/76; Japanese Patent Application (OPI) Nos. 47335/73, 43923/75 and 87028/75; Japanese Patent Application No. 177989/81; U.S. Pat. Nos. 3,770,431 and 3,811,891; U.S. (Def. Pub.) T900028; *Research Disclosure*, vol. 101, RD-10133; and so on.

More specifically, useful gaseous fog inhibitors are urea, ethylene diurea, ethylene urea, melamine, hydantoin, allantoin, urazole, parabanic acid, biuret, glycoluril, 1-methylglycoluril, phtalimide, succinimide, benzenesulfinic acid, styrenesulfinic acid polymers, malonic acid, cyanoacetic acid, dimedone barbituric acid, semicarbazide, 5-pyrazolone magenta couplers, acylacetanilide yellow couplers, resolcinol, phloroglucin, 2,3-dihydroxynaphthalene, sodium sulfite and so on.

Photographic processings of the light-sensitive material of the present invention can be carried out using conventional methods. Therein, known processing solutions can be employed. Processing temperatures are generally selected from the range of 18° C. to 50° C. Of course, temperatures lower than 18° C. or those higher than 50° C. may be employed as the case may be. Both development processing for forming silver image (black and white photographic processing) and color photographic processing which comprises the development processing to form color images can be applied to the light-sensitive material of the present invention depending upon its end-use purpose.

A developing solution which can be employed for the black and white photographic processing can contain known developing agents. As such developing agents, dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, heterocyclic compounds such that a 1,2,3,4-tetrahydroquinoline ring and an indolene ring may be condensed, as described in U.S. Pat. No. 4,067,872 and so on can be used individually or in combination of two or more thereof. In addition to the developing agent as described above, the developing solution may generally contain a known preservative, an alkali agent, a pH buffer, an antifoggant and optionally, a dissolving aid, a color toning agent, a development accerelator, a surface active agent, a defoaming agent, a water softener, a hardener, a viscosity imparting agent and so on.

Moreover, a special development-processing method in which a developing agent is incorporated in a photographic material, especially in its emulsion layer, and the photographic material is treated in an alkaline aqueous solution to effect development may be employed in the present invention. If the developing agent to be employed is hydrophobic, it can be incorporated into an emulsion layer in the form of a latex dispersion, as disclosed in *Research Disclosure,* No. 169, RD-16928. The development processing of this kind may be carried out in combination with the silver salt stabilizing processing which comprises using a thiocyanate.

A fixing solution which can be used includes those having conventionally used compositions.

Suitable examples of the fixing agent which can be contained therein include not only thiosulfates and thiocyanates but also organic sulfur compounds which are known to have a fixing effect.

The fixing solution may contain water-soluble aluminum salts as a hardener.

Formation of color images can be effected using conventional processes. For instance, the negative-positive process (as described in, e.g., *Journal of the Society of Motion Picture and Television Engineers,* vol 61, pp. 667–701 (1953)), the color reversal process in which a negative silver image is first formed by the treatment with a developing solution containing a black and white developing agent and then, uniform exposure or another proper fogging processing is carried out at least once and subsequently, color development is conducted to result in formation of the positive dye image, or so on can be employed.

A color developing solution generally comprises an alkaline aqueous solution containing a color developing agent. Suitable examples of the color developing agent which can be employed include known primary aromatic amine developers such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.).

In addition to the above-described compounds, those described in L. F. A. Mason, *Photographic Processing Chemistry,* pp. 226–229, Focal Press, London (1966); U.S. Pat. Nos. 2,193,015 and 2,592,364; Japanese Patent Application (OPI) No. 64933/73; and so on may be employed as the color developing agent.

Besides containing a color developing agent, the color developing solution can contain a pH buffer agent such as an alkali metal sulfite, an alkali metal carbonate, an alkali metal borate and an alkali metal phosphate; and a development restrainer or an antifoggant such as a bromide, an iodide and an organic antifoggant. In addition, the color developing solution may optionally contain a water softener, a preservative like hydroxylamine, an organic solvent like benzyl alcohol or diethylene glycol, a development accelerator such as polyethylene glycol, quaternary ammonium salts or amines, dye forming couplers, competing couplers, a fogging agent like sodium borohydride, an auxiliary developing agent like 1-phenyl-3-pyrazolidone, a viscosity imparting agent, a chelating agent of polycarboxylic acid type as described in U.S. Pat. No. 4,083,723; an antioxidant as described in West German Patent Application (OLS) No. 2,622,950; and so on.

The photographic emulsion layers having received a color development-processing are generally subjected to a bleaching processing. The bleaching processing may be carried out simultaneously with the fixing processing, or separately from the fixing processing. Bleaching agents which can be employed therein include compounds of polyvalent metals such as Fe (III), Co (III), Cr (VI), Cu (II), etc.; peroxy acids, quinones; nitroso compounds and so on. More specifically, ferricyanides, dichromates, Fe (III) or Co (III) complex salts of organic acids such as aminopolycarboxylic acids (e.g., ethylenediaminetetraacetic acid, nitrilotriacetic acid, 1,3-diamino-2-propanoltetraacetic acid, etc.), citric acid, tartaric acid, malic acid and so on; persulfates, permanganates; nitrosophenol; and so on can be employed as the bleaching agent. Among these compounds, potassium ferricyanide, sodium(ethylenediaminetetraacetato)iron (III) and ammonium(ethylenediaminetetraacetato)iron (III) are particularly useful. (Ethylenediaminetetraacetato)iron (III) complex salts are useful in both an independent bleaching solution and a combined bleaching and fixing solution.

The invention will now be described in referring to the following specific examples and samples. However. the scope of the present invention is in no way limited thereto.

EXAMPLE 1

| | |
|---|---|
| Composition of Solution I: | |
| Gelatin | 30 g |
| $H_2O$ | 440 cc |
| Potassium Bromide | 20 g |
| Composition of Solution II: | |
| Silver Nitrate | 200 g |
| $H_2O$ | 900 cc |
| Composition of Solution III: | |
| Potassium Bromide | 140 g |
| Potassium Iodide | 8 g |
| $H_2O$ | 900 cc |

Before precipitation of silver halide, Compound I-1, which is a silver halide solvent represented by the foregoing general formula (I), was added to the solution I in an amount of $2\times10^{-3}$ mole. The resulting solution I was kept at 75° C., and the solution II and the solution III were simultaneously added dropwise thereto over 60 minutes with vigorous stirring as the temperature of the system was kept at 75° C. Thus, a silver iodobromide emulsion (silver iodine content: 4 mol%) having a mean grain diameter of about 0.5 micron was produced. After cooling, removal of the soluble salts from the emulsion produced was carried out, and gelatin was added to the desalted emulsion in such an amount as to make the emulsion 1,000 cc. Then, the emulsion was subjected to sulfur sensitization and gold sensitization using methods as described in U.S. Pat. No. 2,399,083. The thus obtained emulsion was named Emulsion A.

Another emulsion named Emulsion B was prepared in the same manner as in Emulsion A except that Compound I-10 was employed as the silver halide solvent represented by the general formula (I) in place of compound I-1.

A further emulsion named Emulsion C was prepared in the same manner as in Emulsion A except that an organic thioether compound having the structural formula;

$$HOC_2H_4SC_2H_4SC_2H_4OH$$

was added in an amount of $1.5\times10^{-3}$ mole as the silver halide solvent in place of the tetrasubstituted thiourea and that a temperature at the time of the preparation of silver halide was so controlled as to make a mean grain diameter about 0.5 micron.

A still another emulsion named Emulsion D was prepared in the same manner as in Emulsion A except that ammonia was employed as the silver halide solvent and that an addition amount of ammonia and a preparation temperature were so controlled as to make a mean grain diameter about 0.5 micron.

Samples having the following layer structure were prepared by coating on a triacetyl cellulose support having a subbing layer the emulsion and the assistant layers having the following compositions in the order described below.

First Layer: Slow Red-sensitive Emulsion Layer

In a mixed solvent composed of 100 cc of tricresyl phosphate and 100 cc of ethyl acetate was dissolved 100 g of 2-(heptafluorobutylamido)-5-{2''-(2'',4''-di-t-amino-phenoxy)-butylamido}-phenol (a cyan coupler). The solution was mixed with 1 Kg of a 10% gelatin aqueous solution with high speed stirring to prepare an emulsion. A 500 g portion of the thus prepared emulsion was mixed with 1 Kg of a red-sensitive silver iodobromide emulsion (containing 70 g of silver, 60 g of gelatin and 4 mol% of silver iodide), and the mixed emulsion was coated in a layer having a dry thickness of 2μ.

Second Layer: Quick Red-sensitive Emulsion Layer

In a mixed solvent composed of 100 cc of tricresyl phosphate and 100 cc of ethyl acetate was dissolved 100 g of 2-(heptafluorobutylamido)-5-{2'-(2'',4''-di-t-amino-phenoxy)-butylamido}-phenol (cyan coupler). The solution was mixed with 1 Kg of a 10% gelatin aqueous solution with stirring at high speed to prepare an emulsion. A 1000 g portion of the thus prepared emulsion was mixed with 1 Kg of a red-sensitive silver iodobromide emulsion (containing 70 g of silver, 60 g of gelatin and 4 mol% of silver iodide), and the mixed emulsion was coated in a layer having a dry thickness of 2μ.

Third Layer: Interlayer 2,5-Di-t-octylhydroquinone was dissolved in a mixed solvent consisting of 100 cc of dibutyl phthalate and 100 cc of ethyl acetate and mixed with 1 Kg of a 10% gelatin aqueous solution with stirring at high speed. 1 Kg portion of the thus obtained emulsion was mixed with 1 Kg of a 10% gelatin aqueous solution and coated in a layer having a dry thickness of 1μ.

Fourth Layer: Slow Green-sensitive Emulsion Layer

A 500 g portion of the emulsion obtained in the same manner as the emulsion in the first layer except that 1-(2,4,6-trichlorophenyl)-3-{3-(2,4-di-t-amylphenoxyacetamido)benzamido}-5-pyrazolone was used as a magenta coupler in place of the cyan coupler was mixed with 1 Kg of a green-sensitive silver iodobromide emulsion (containing 70 g of silver, 60 g of gelatin and 4 mol% of silver iodide) and coated in a layer having a dry thickness of 2μ.

Fifth Layer: Quick Green-sensitive Emulsion Layer

A 1,000 g portion of the emulsion obtained in the same manner as the emulsion in the first layer except that 1-(2,4,6-trichlorophenyl)-3-{3-(2,4-di-t-amylphenoxyacetamido)benzamido}-5-pyrazolone was used as a magenta coupler in place of the cyan coupler was mixed with 1 Kg of a green-sensitive silver iodobromide emulsion (containing 70 g of silver, 60 g of gelatin and 4 mol% of silver iodide) and coated in a layer having a dry thickness of 2μ.

Sixth Layer: Interlayer

1 Kg of the same emulsion as employed in the third layer was mixed with 1 Kg of a 10% gelatin aqueous solution and coated in a layer having a dry thickness of 1μ.

Seventh Layer: Yellow Filter Layer

An emulsion containing yellow colloidal silver was coated in a layer having a dry thickness of 1μ.

Eighth Layer: Slow Blue-sensitive Emulsion Layer

A 1,000 g portion of the emulsion obtained in the same manner as the emulsion in the first layer except that α-(pivaloyl)-α-(1-benzyl-5-ethoxy-3-hydantoinyl)-2-chloro-5-dodecyloxycarbonylacetanilide was employed as a yellow coupler in place of the cyan coupler was mixed with 1 Kg of a blue-sensitive silver iodobromide emulsion (containing 70 g of silver, 60 g of gelatin and 4 mol% of silver iodide) and coated in a layer having a dry thickness of 2.0μ.

Ninth Layer: Quick Blue-sensitive Emulsion Layer

A 1,000 g portion of the emulsion obtained in the same manner as the emulsion in the first layer except that α-(pivaloyl)-α-(1-benzyl-5-ethoxy-3-hydantoinyl)-2-chloro-5-dodecyloxycarbonylacetanilide was employed as a yellow coupler in place of the cyan coupler was mixed with 1 Kg of a blue-sensitive silver iodobromide emulsion (containing 70 g of silver, 60 g of gelatin and 4 mol% of silver iodide) and coated in a layer having a dry thickness of 2μ.

Tenth Layer: Second Protective Layer

1 Kg of the same emulsion as employed in the third layer was mixed with 1 Kg of a 10% gelatin aqueous solution and coated in a layer having a dry thickness of 2μ.

Eleventh Layer: First Protective Layer

A 10% gelatin aqueous solution containing a chemically unsensitized fine-grained emulsion (having a grain size of 0.15μ containing 1 mol% of silver iodobromide) was coated in a layer having a coverage of silver of 0.3 g/m$^2$ and a dry thickness of 1μ.

Multilayer coated film samples 1 to 6 were obtained using as the silver iodobromide emulsions of the foregoing first, fourth and eighth layers those set forth in the following Table 1 respectively and using as a hardener those described in the following Table 1 respectively and further, adding a stabilizer and a coating aid in this order to each emulsion layer.

TABLE 1

| | Sample 1 | Sample 2 | Sample 3 | Sample 4 | Sample 5 | Sample 6 |
|---|---|---|---|---|---|---|
| Red-sensitive Silver Iodobromide Emulsion in First Layer (Slow Red-sensitive Emulsion Layer) | Emulsion A | Emulsion A | Emulsion A | Emulsion B | Emulsion C | Emulsion D |
| Green-sensitive silver Iodobromide Emulsion | Emulsion A | Emulsion A | Emulsion A | Emulsion B | Emulsion C | Emulsion D |

TABLE 1-continued

| | Sample 1 | Sample 2 | Sample 3 | Sample 4 | Sample 5 | Sample 6 |
|---|---|---|---|---|---|---|
| in Fourth Layer (Slow Green-sensitive Emulsion Layer) | | | | | | |
| Blue-sensitive Silver Iodobromide Emulsion in Eighth Layer (Slow Blue-sensitive Emulsion Layer) | Emulsion A | Emulsion A | Emulsion A | Emulsion B | Emulsion C | Emulsion D |
| Hardener used | 2,4-Dichloro-6-hydroxy-s-triazine | 1,3-Bisvinylsulfonyl-2-hydroxypropane | 1,2-Bis(vinylsulfonylacetamido)ethane | | | |

In order to examine the storability of each sample and the stability of the latent image formed therein under various forced deterioration conditions, each of samples 1 to 6 was stored under the conditions described in Table 2 and then, exposed to light. For the exposure, sensitometry using a silver-evaporated continuous wedge was employed. Each of the thus exposed films was subjected to the following color reversal processings, and its photographic properties were judged by comparison.

Processings

| Step | Time | Temperature |
|---|---|---|
| First Development | 6 min. | 38° C. |
| Water-washing | 2 min. | " |
| Reversal | 2 min. | " |
| Color Development | 6 min. | " |
| Compensation | 2 min. | " |
| Bleaching | 6 min. | " |
| Fixation | 4 min. | " |
| Water-washing | 4 min. | " |
| Stabilization | 1 min. | Room Temperature |
| Drying | | |

Compositions of processing solutions used were as follows:

First Developing Solution

| | |
|---|---|
| Water | 700 ml |
| Sodium Tetrapolyphosphate | 2 g |
| Sodium Sulfite | 20 g |
| Hydroquinone Monosulfonate | 30 g |
| Sodium Carbonate (Monohydrate) | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% solution) | 2 ml |
| Water to make | 1000 ml |
| (pH = 10.1) | |
| Reversal Solution | |
| Water | 700 ml |
| Hexasodium Nitrilo-N,N,N—trimethylenephosphonate | 3 g |
| Stannous Chloride (Dihydrate) | 1 g |
| P-Aminophenol | 0.1 g |
| Sodium Hydroxide | 8 g |
| Glacial Acetic Acid | 15 ml |
| Water to make | 1000 ml |
| Color Developing Solution | |
| Water | 700 ml |
| Sodium Tetrapolyphosphate | 2 g |
| Sodium Sulfite | 7 g |
| Sodium Tertiary Phosphate (Dodecahydrate) | 36 g |
| Potassium Bromide | 1 g |
| Potassium Iodide (0.1% solution) | 90 ml |
| Sodium Hydroxide | 3 g |
| Citrazinic Acid | 1.5 g |
| N—Ethyl-N—(β-methanesulfonamidoethyl)-3-methyl-4-aminoaniline Sulfate | 11 g |
| Ethylenediamine | 3 g |

-continued

| | |
|---|---|
| Water to make | 1000 ml |
| Compensating Solution | |
| Water | 700 ml |
| Sodium Sulfite | 12 g |
| Sodium Ethylenediaminetetraacetate (Dihydrate) | 8 g |
| Thioglycerine | 0.4 ml |
| Glacial Acetic Acid | 3 ml |
| Water to make | 1000 ml |
| Bleaching Solution | |
| Water | 800 ml |
| Sodium Ethylenediaminetetraacetate (Dihydrate) | 2 g |
| Ammonium (Ethylenediaminetetraacetato)iron (III) (Dihydrate) | 120 g |
| Potassium Bromide | 100 g |
| Water to make | 1000 ml |
| Fixing Solution | |
| Water | 800 ml |
| Ammonium Thiosulfate | 80 g |
| Sodium Sulfite | 5 g |
| Sodium Bisulfite | 5 g |
| Water to make | 1000 ml |
| Stabilizing Solution | |
| Water | 800 ml |
| Formaline (37 wt %) | 5 ml |
| Fuji Dri Wel | 5 ml |
| Water to make | 1000 ml |

TABLE 2

| Condition No. | Conditions for Storage and Exposure |
|---|---|
| 1 | After storage in a freezer kept at −20° C., samples were exposed to light. (Standard) |
| 2 | After storage in the atmosphere kept at a temperature of 35° C. and a relative humidity of 80% for 14 days, samples were exposed to light. |
| 3 | After storage in the atmosphere kept at a temperature of 45° C. and a relative humidity of 80% for 3 days, samples were exposed to light. |
| 4 | After exposure to light, samples were stored in the atmosphere kept at a temperature of 35° C. and a relative humidity of 40% for 14 days. |
| 5 | After exposure to light, samples were stored in the atmosphere kept at a temperature of 35° C. and a relative humidity of 70% for 14 days. |

Comparison of photographic properties was carried out using the maximum density and the relative sensitivity (log E) at a density of 0.9 which were read in the characteristic curve obtained. As for the density measurement, yellow, magenta and cyan densities were measured using a Status A filter of Macbeth.

Differences between the above-described characteristic values obtained when each of the samples 1 to 6 was stored under the condition 1 and those obtained when it was stored under each of the conditions 2 to 5 are set forth in Table 3 with respect to yellow (Y), magenta (M) and cyan (C) each.

TABLE 3

| Sample No. | Color | Condition 1* | Condition 2 | Condition 3 | Condition 4 | Condition 5 |
|---|---|---|---|---|---|---|
| (a) Change in Maximum Density | | | | | | |
| 1 | Y | 0.00 | −0.16 | −0.32 | −0.08 | −0.13 |
| (Comparison) | M | 0.00 | −0.18 | −0.21 | −0.12 | −0.17 |
| | C | 0.00 | −0.20 | −0.26 | −0.13 | −0.18 |
| 2 | Y | 0.00 | −0.23 | −0.33 | −0.20 | −0.15 |
| (Invention) | M | 0.00 | −0.26 | −0.24 | −0.21 | −0.19 |
| | C | 0.00 | −0.30 | −0.31 | −0.18 | −0.20 |
| 3 | Y | 0.00 | −0.20 | −0.33 | −0.18 | −0.15 |
| (Invention) | M | 0.00 | −0.23 | −0.30 | −0.19 | −0.17 |
| | C | 0.00 | −0.29 | −0.31 | −0.17 | −0.18 |
| 4 | Y | 0.00 | −0.23 | −0.40 | −0.19 | −0.15 |
| (Invention) | M | 0.00 | −0.23 | −0.33 | −0.21 | −0.19 |
| | C | 0.00 | −0.30 | −0.31 | −0.18 | −0.19 |
| 5 | Y | 0.00 | −0.49 | −0.80 | −0.33 | −0.39 |
| (Comparison) | M | 0.00 | −0.50 | −0.92 | −0.36 | −0.44 |
| | C | 0.00 | −0.59 | −0.70 | −0.40 | −0.46 |
| 6 | Y | 0.00 | −0.68 | −0.63 | −0.39 | −0.56 |
| (Comparison) | M | 0.00 | −0.80 | −1.04 | −0.45 | −0.70 |
| | C | 0.00 | −0.80 | −1.10 | −0.50 | −0.66 |
| (b) Change in Sensitivity (log E) at Density of 0.9 | | | | | | |
| 1 | Y | 0.00 | −0.05 | −0.04 | −0.10 | −0.10 |
| (Comparison) | M | 0.00 | −0.09 | −0.14 | −0.13 | −0.15 |
| | C | 0.00 | +0.01 | +0.10 | −0.12 | −0.18 |
| 2 | Y | 0.00 | −0.00 | +0.05 | −0.03 | −0.04 |
| (Invention) | M | 0.00 | +0.02 | +0.04 | −0.04 | −0.05 |
| | C | 0.00 | +0.03 | +0.06 | −0.03 | −0.05 |
| 3 | Y | 0.00 | +0.04 | +0.05 | −0.02 | −0.02 |
| (Invention) | M | 0.00 | +0.01 | +0.04 | −0.02 | −0.02 |
| | C | 0.00 | +0.02 | +0.06 | −0.03 | −0.02 |
| 4 | Y | 0.00 | +0.06 | +0.08 | −0.06 | −0.04 |
| (Invention) | M | 0.00 | −0.01 | +0.02 | −0.04 | −0.05 |
| | C | 0.00 | +0.03 | +0.06 | −0.04 | −0.05 |
| 5 | Y | 0.00 | −0.12 | −0.09 | −0.11 | −0.12 |
| (Comparison) | M | 0.00 | −0.20 | −0.06 | −0.08 | −0.08 |
| | C | 0.00 | +0.03 | +0.01 | −0.07 | −0.09 |
| 6 | Y | 0.00 | −0.11 | −0.10 | −0.08 | −0.05 |
| (Comparison) | M | 0.00 | −0.18 | −0.15 | −0.06 | −0.09 |
| | C | 0.00 | +0.05 | +0.04 | −0.07 | −0.10 |

*Reference

It is evident from the results set forth in Table 3 that the samples 2 to 4 are superior in storability to the samples 5 and 6. Superiority of the samples 2 to 4 in stability of latent image is also apparent. More specifically, it is obvious from Table 3 that the samples 2, 3 and 4, which are silver halide color light-sensitive materials containing the silver halide emulsions prepared in the presence of the tetrasubstituted thiourea as silver halide solvent and using the vinylsulfonyl group-containing hardeners as a hardener for the emulsion layers to be coated on a support, are superior in both keeping stability and latent image stability to the sample 5, which is the silver halide color light-sensitive material containing the silver halide emulsions prepared in the presence of the thioether as silver halide solvent and using the vinylsulfonyl group-containing hardener as a hardener for the emulsion layers to be coated on a support, and to the sample 6, which is the silver halide color light-sensitive material containing the silver halide emulsions prepared in the presence of the ammonia as silver halide solvent and using the vinylsulfonyl group-containing hardener as a hardener for the emulsion layers to be coated on a support. In addition, the latent image stabilities of the samples of the present invention, 2, 3 and 4, are higher than that of the sample 1 in which 2,4-dichloro-6-hydroxy-s-triazine was used as the hardener for the silver halide emulsion prepared in the presence of the tetrasubstituted thiourea as silver halide solvent. Accordingly, the combination of the silver halide solvent of the present invention and the hardener of the present invention has proved to be superior to other combinations.

EXAMPLE 2

| | |
|---|---|
| Solution I | |
| Gelatin | 30 g |
| $H_2O$ | 440 g |
| Potassium Bromide | 20 g |
| Solution II | |
| Silver Nitrate | 200 g |
| $H_2O$ | 900 cc |
| Solution III | |
| Potassium Bromide | 140 g |
| Potassium Iodide | 10 g |
| $H_2O$ | 900 cc |

Preparation of Emulsion E

Before precipitation of silver halide, Compound I-1, which is a silver halide solvent represented by the foregoing general formula (I), was added to the solution I in an amount of $2\times10^{-3}$ mole. The resulting solution I was kept at 65° C., and both the solution II and the solution III were added dropwise thereto at the same time over 60 minutes with vigorous stirring as a temperature of the system was kept at 65° C. Thus, a silver iodobromide emulsion (silver iodide content: 5 mole%) having a mean grain diameter of about 0.3 micron was produced. After cooling, removal of the soluble salts from the emulsion produced was carried out, and gelatin was added to the desalted emulsion in such an amount as to make the emulsion 1,000 cc. Then, the emulsion was subjected to sulfur sensitization and gold sensitization using methods as described in U.S. Pat. No. 2,399,083.

Preparation of Emulsion F

Another emulsion was prepared in the same manner as in Emulsion E except that Compound I-10 was employed as the silver halide solvent represented by the general formula (I) in place of Compound I-1.

Preparation of Emulsion G

A further emulsion was prepared in the same manner as in Emulsion E except that an organic thioether compound having the structural formula, $HOC_2H_4SC_2H_4SC_2H_4OH$, was added in an amount of $1.5\times10^{-3}$ mole as the silver halide solvent in place of Compound I-1 and that a temperature at the time of the preparation of silver halide was so controlled as to make a mean grain diameter about 0.3 micron.

Preparation of Emulsion H

A still another emulsion was prepared in the same manner as in Emulsion E except that ammonia was employed as the silver halide solvent and that an addition amount of ammonia and a preparation temperature were so controlled as to make a mean grain diameter of the emulsion obtained about 0.3 micron.

Samples 7 to 10 for a multilayer color light-sensitive material were prepared using the above-described emulsions by coating on a polyethylene terephthalate film support the layers having the following compositions in the order of description.

(Sample 7)

First Layer: Antihalation layer (AHL) which was a gelatin layer containing black colloidal silver.

Second Layer: Interlayer (ML) which was a gelatin layer containing an emulsified dispersion of 2,5-di-t-octylhydroquinone.

Third Layer: First red-sensitive emulsion layer ($RL_1$) containing Emulsion E at a coverage of silver of 0.8 g/m$^2$, Sensitizing Dye I in an amount of $1.5\times10^{-5}$ mole per mole of silver, Sensitizing Dye II in an amount of $1.5\times10^{-5}$ mole per mole of silver, Coupler C-4 in an amount of 0.04 mole per mole of silver, Coupler EX-1 in an amount of 0.003 mole per mole of silver, and Coupler D-3 in an amount of 0.0006 mole per mole of silver.

Fourth Layer: Second red-sensitive emulsion layer ($RL_2$) containing a silver iodobromide monodispersed emulsion (containing 7 mole % of silver iodide and 1.4 g/m$^2$ of silver, and having a mean grain diameter of 0.65$\mu$), $3\times10^{-5}$ mole per mole of silver of Sensitizing Dye I, $1.2\times10^{-5}$ mole per mole of silver of Sensitizing Dye II, 0.017 mole per mole of silver of Coupler C-1, 0.003 mole per mole of silver of Coupler C-4, and 0.0016 mole per mole of silver of Coupler EX-1.

Fifth Layer: Interlayer (ML) which was the same one as the second layer.

Sixth Layer: First green-sensitive emulsion layer ($GL_1$) containing 1.5 g silver per square meter of Emulsion E, $3\times10^{-5}$ mole per mole of silver of Sensitizing Dye III, $1\times10^{-5}$ mole per mole of silver of Sensitizing Dye IV, 0.05 mole per mole of silver of Coupler M-4, 0.008 mole per mole of silver of Coupler EX-3, and 0.0015 mole per mole of silver of Coupler EX-2.

Seventh Layer: Second green-sensitive emulsion layer ($GL_2$) containing a silver iodobromide monodispersed emulsion (containing 8 mole % of silver iodide and 1.6 g/m$^2$ of silver, and having a mean grain diameter of 0.60$\mu$), $2.5\times10^{-5}$ mole per mole of silver of Sensitizing Dye III, $0.8\times10^{-5}$ mole per mole of silver of Sensitizing Dye IV, 0.02 mole per mole of silver of Coupler M-4, and 0.003 mole per mole of silver of Coupler EX-3.

Eighth Layer: Yellow filter layer (YFL) which was a gelatin layer containing yellow colloidal silver and an emulsified dispersion of 2,5-di-t-octylhydroquinone in a gelatin aqueous solution.

Ninth Layer: First blue-sensitive emulsion layer ($BL_1$) containing 1.5 g silver per square meter of Emulsion E, 0.25 mole per mole of silver of Coupler Y-1 and 0.015 mole per mole of silver of Coupler EX-2.

Tenth Layer: Second blue-sensitive emulsion layer ($BL_2$) containing a silver iodobromide emulsion (containing 6 mole % of silver iodide and 1.19 g/m$^2$ of silver, and having a mean grain diameter of 0.7$\mu$) and 0.06 mole per mole of silver of Coupler Y-1.

Eleventh Layer: First protective layer ($PL_1$) which was a gelatin layer containing 0.5 g silver per square meter of silver iodobromide (containing 1 mole % of silver iodide and having a mean grain diameter of 0.07$\mu$) and an emulsified dispersion of Ultraviolet Absorbent UV-1.

Twelfth Layer: Second protective layer ($PL_2$) which was a gelatin layer containing polymethyl methacrylate grains (having a diameter of about 1.5$\mu$).

In each of the above-described layers, Gelatin Hardener H-1 and a surface active agent were added in addition to the above-described ingredients.

The thus prepared light-sensitive material was named sample 7.

Compounds employed for the preparation of the sample were described in detail below.

Sensitizing Dye I: Anhydro-5,5'-dichloro-3,3'-di-($\gamma$-sulfopropyl)-9-ethyl-thiacarbocyaninehydroxide pyridinium salt.

Sensitizing Dye II: Anhydro-9-ethyl-3,3'-di-($\gamma$-sulfopropyl)-4,5,4',5'-dibenzothiacarbocyaninehydroxide triethylamine salt.

Sensitizing Dye III: Anhydro-9-ethyl-5,5'-dichloro-3,3'-di-($\gamma$-sulfopropyl)oxacarbocyanine sodium salt.

Sensitizing Dye IV: Anhydro-5,6,5',6'-tetrachloro-1,1'-diethyl-3,3'-di-[$\beta$-{$\beta$-($\gamma$-sulfopropxy)ethoxy}ethyl-]imidazolocarbocyaninehydroxide sodium salt.

Coupler C-1

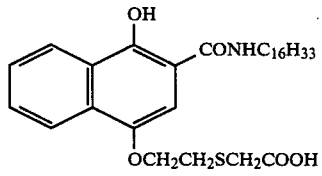

Coupler C-4

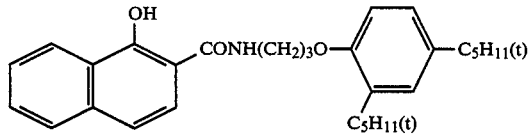

Coupler D-3

-continued
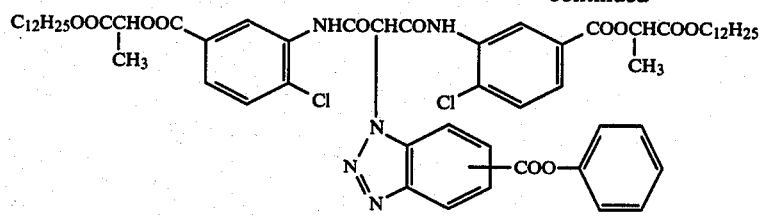
Coupler M-4
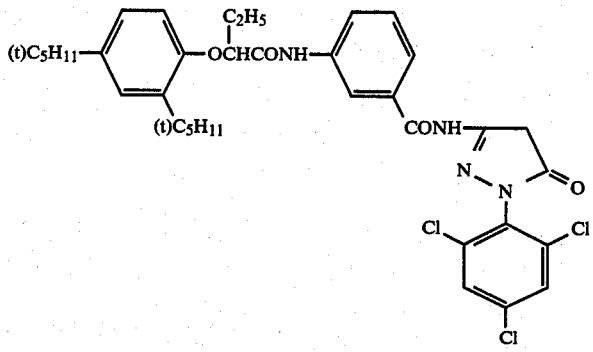
Coupler Y-1
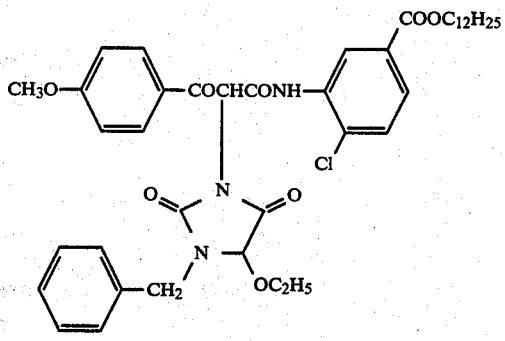
Coupler EX-1
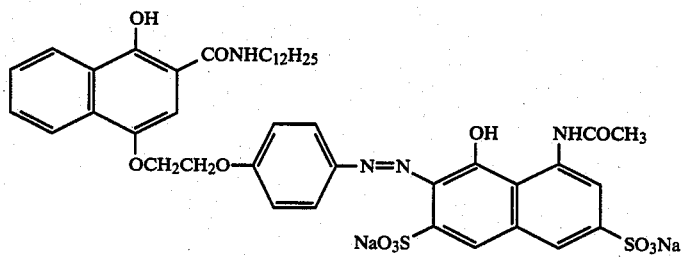
Coupler EX-2
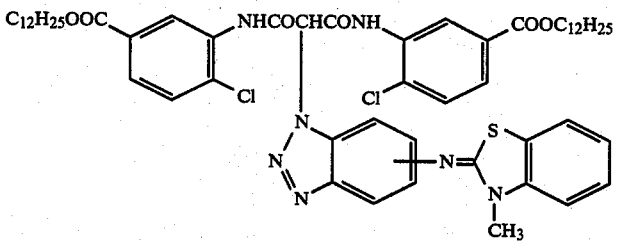
Coupler EX-3

-continued

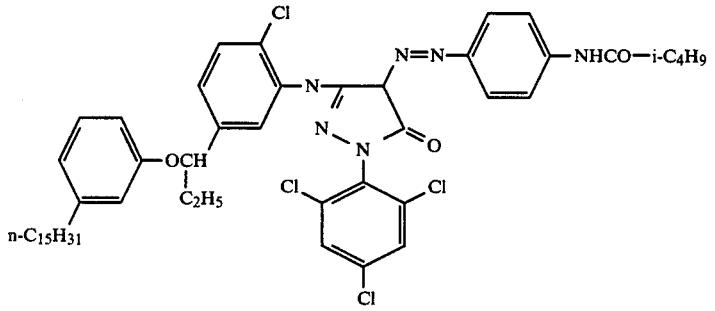

Hardener H-1

$CH_2{=}CH{-}SO_2{-}CH_2CONHCH_2{-}CH_2NHCOCH_2{-}SO_2{-}CH{=}CH_2$

Ultraviolet Absorbent UV-1

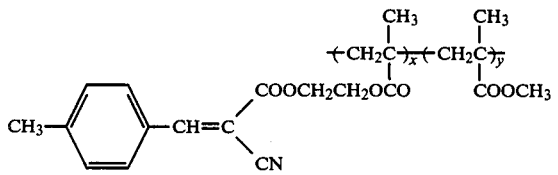

x/y = 7/3 (by weight)

(Sample 8)

A light-sensitive material was prepared in the same manner as in sample 7 except that Emulsion F was employed in place of Emulsion E contained in the first red-sensitive emulsion layer ($RL_1$) of the third layer, the first green-sensitive emulsion layer ($GL_1$) of the sixth layer, and the first blue-sensitive emulsion layer ($BL_1$) of the ninth layer.

(Sample 9)

A light-sensitive material was prepared in the same manner as in sample 7 except that Emulsion G was employed in place of Emulsion E contained in the first red-sensitive emulsion layer ($RL_1$) of the third layer, the first green-sensitive emulsion layer ($GL_1$) of the sixth layer, and the first blue-sensitive emulsion layer ($BL_1$) of the ninth layer.

(Sample 10)

A light-sensitive material was prepared in the same manner as in sample 7 except that Emulsion H was employed in place of Emulsion E contained in the first red-sensitive emulsion layer ($RL_1$) of the third layer, the first green-sensitive emulsion layer ($GL_1$) of the sixth layer, and the first blue-sensitive emulsion layer ($BL_1$) of the ninth layer.

After being stored and exposed to light under the conditions 1 to 5 described in Table 2 of Example 1, each of the thus prepared samples 7 to 10 was subjected to the following development processings. Photographic properties obtained were compared among these samples. Therein, the exposure to light was carried out using white light and an optical wedge.

Development processings employed herein were as follows, and they were carried out at a temperature of 38° C.

| Steps | Time |
|---|---|
| 1. Color Development | 3 min. and 15 sec. |
| 2. Bleaching | 6 min. and 30 sec. |
| 3. Water-washing | 3 min. and 15 sec. |
| 4. Fixation | 6 min. and 30 sec. |
| 5. Water-washing | 3 min. and 15 sec. |
| 6. Stabilization | 3 min. and 15 sec. |

Compositions of processing solutions employed in these steps were described below.

| | |
|---|---|
| Color Developing Solution | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—Ethyl-N—β-hydroxyethylamino)-2-methyl-anilinosulfate | 4.5 g |
| Water to make | 1 l |
| Bleaching Solution | |
| Ammonium Bromide | 160.0 g |
| Ammonia Water (28%) | 25.0 ml |
| Sodium (Ethylenediaminetetraacetonato)iron (III) | 130 g |
| Glacial Acetic Acid | 14 ml |
| Water to make | 1 l |
| Fixing Solution | |
| Sodium Tetrapolyphosphate | 2.0 g |
| Sodium Sulfite | 4.0 g |
| Ammonium Thiosulfate (70%) | 175.0 ml |
| Sodium Bisulfite | 4.6 g |
| Water to make | 1 l |
| Stabilizing Solution | |
| Formaline | 8.0 ml |
| Water to make | 1 l |

Comparison of photographic properties was carried out using the minimum density and the relative sensitivity (log E) at a density of (1.0+minimum density) which were read in the characteristic curve obtained by measurement with each of blue light (B), green light (G) and red light (R). Differences between the above-described characteristic valves obtained when each of the samples 7 to 10 was stored under the condition 1 described in Table 2 and those obtained when it was stored under each of the conditions 2 to 5 described in Table 2 are set forth in Table 4 with respect to B-layer, G-layer and R-layer each. The densities were measured using a Status A filter of Macbeth.

TABLE 4

| Sample No. | Light | Condition 1 | Condition 2 | Condition 3 | Condition 4 | Condition 5 |
|---|---|---|---|---|---|---|
| | (a) Change in Miniumum Density | | | | | |
| 7 | B | 0.00 | +0.04 | +0.06 | +0.02 | +0.03 |
| (Invention) | G | 0.00 | +0.02 | +0.03 | +0.01 | +0.02 |
| | R | 0.00 | +0.02 | +0.04 | +0.01 | +0.02 |
| 8 | B | 0.00 | +0.06 | +0.09 | +0.04 | +0.05 |
| (Invention) | G | 0.00 | +0.03 | +0.05 | +0.03 | +0.04 |
| | R | 0.00 | +0.04 | +0.06 | +0.03 | +0.04 |
| 9 | B | 0.00 | +0.15 | +0.18 | +0.12 | +0.13 |
| (Comparison) | G | 0.00 | +0.07 | +0.09 | +0.06 | +0.07 |
| | R | 0.00 | +0.08 | +0.10 | +0.07 | +0.07 |
| 10 | B | 0.00 | +0.17 | +0.20 | +0.15 | +0.17 |
| (Comparison) | G | 0.00 | +0.10 | +0.12 | +0.08 | +0.10 |
| | R | 0.00 | +0.11 | +0.15 | +0.08 | +0.10 |
| | (b) Change in Sensitivity (log E) at Density of Minimum Density + 1.0 | | | | | |
| 7 | B | 0.00 | −0.03 | −0.04 | −0.05 | −0.06 |
| (Invention) | G | 0.00 | −0.02 | −0.02 | +0.03 | +0.03 |
| | R | 0.00 | −0.02 | −0.01 | +0.04 | +0.02 |
| 8 | B | 0.00 | −0.03 | −0.05 | −0.06 | −0.04 |
| (Invention) | G | 0.00 | −0.02 | −0.02 | +0.02 | +0.04 |
| | R | 0.00 | −0.01 | −0.03 | +0.04 | +0.01 |
| 9 | B | 0.00 | −0.10 | −0.12 | −0.07 | −0.05 |
| (Comparison) | G | 0.00 | −0.06 | −0.09 | +0.03 | +0.04 |
| | R | 0.00 | −0.05 | −0.08 | +0.05 | +0.02 |
| 10 | B | 0.00 | −0.14 | −0.17 | −0.05 | −0.06 |
| (Comparison) | G | 0.00 | −0.09 | −0.11 | +0.04 | +0.03 |
| | R | 0.00 | −0.07 | −0.10 | +0.04 | +0.03 |

It is evident from the results shown in Table 4 that the samples 7 and 8 (this invention) are superior in storability to the samples 9 and 10 (comparison). That is, the emulsions prepared using tetrasubstituted thioureas as the silver halide solvent can provide color light-sensitive materials with better storability than those prepared using thioether compounds or ammonia as the silver halide solvent.

While the invention has been described in detail and with reference to specific embodiments thereof, it will be apparent to one skilled in the art that various changes and modifications can be made therein without departing from the spirit and scope thereof.

What is claimed is:

1. A silver halide color light-sensitive material comprising a support having provided thereon at least no silver halide emulsion layer hardened with a hardener containing a vinyl-sulfonyl group, the emulsion layer containing a silver halide prepared in the presence of a tetrasubstituted thiourea as a silver halide solvent and containing a color forming coupler.

2. A silver halide light-sensitive material as claimed in claim 1, wherein the tetrasubstituted thiourea is a solvent having the general formula (I):

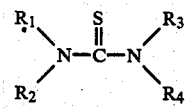

(I)

wherein $R_1$, $R_2$, $R_3$ and $R_4$, which may be the same or different, each represents a substituted or unsubstituted alkyl group, a substituted or unsubstituted alkenyl group, a substituted or unsubstituted aryl group, or a substituted or unsubstituted nitrogen-containing heterocyclic ring.

3. A silver halide light-sensitive material as claimed in claim 2, wherein the substituents $R_1$ to $R_4$ contain a total of 30 or less carbon atoms.

4. A silver halide light-sensitive material as claimed in claim 1, wherein the tetrasubstituted thiourea is added prior to the physical ripening of the silver halide.

5. A silver halide light-sensitive material as claimed in claim 1, wherein the silver halide is formed at a temperature in the range of about 30° C. to 90° C., a pH of about 9 or less, and a pAg of about 10 or less.

6. A silver halide light-sensitive material as claimed in claim 5, wherein the silver halide has a mean grain diameter in the range of about 0.2 to 4 microns.

7. A silver halide light-sensitive material as claimed in claim 1, wherein the tetrasubstituted thiourea is is used in an amount in the range of about $1\times10^{-5}$ to $5\times10^{-2}$ mole per mole of the silver halide.

8. A silver halide light-sensitive material as claimed in claim 1, wherein the hardener has the general formula (II):

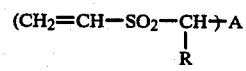

(II)

wherein R represents a hydrogen atom or a lower alkyl group; and A represents a divalent group which is optionally present.

9. A silver halide light-sensitive material as claimed in claim 1, wherein the hardener is used in a proportion of 0.1 to 10 wt% based on the weight of dried gelatin within the emulsion layer.

10. A silver halide color light-sensitive material comprising a support having provided thereon at least one red-sensitive emulsion layer containing a cyan color forming coupler, at least one green-sensitive emulsion layer containing a magenta color forming coupler and at least one blue-sensitive emulsion layer containing a yellow color forming coupler; wherein at least one of the silver halide emulsion layers is hardened with a hardener containing a vinyl-sulfonyl group, the emulsion layer containing a silver halide prepared in the presence of a tetrasubstituted thiourea as a silver halide solvent.

11. A silver halide light-sensitive material as claimed in claim 1, wherein the tetrasubstituted thiourea is used in an amount in the range of about $1\times10^{-4}$ to $2.5\times10^{-2}$ mole per mole of the silver halide.

12. A silver halide light-sensitive material as claimed in claim 1, wherein the hardener is used in a proportion of 0.5 to 5 wt. % based on the weight of dried gelatin within the emulsion layer.

13. A silver halide light-sensitive material as claimed in claim 1, that exhibits improved long-range storability.

14. A silver halide light-sensitive material as claimed in claim 1, that exhibits reduced fading of the latent image.

15. A silver halide light-sensitive material as claimed in claim 1, wherein gelatin is used as a binder.

16. A silver halide light-sensitive material as claimed in claim 2, wherein the hardener has the general formula (II):

$$(CH_2{=}CH{-}SO_2{-}\underset{\underset{R}{|}}{CH}\rightarrow A$$

wherein R represents a hydrogen atom or a lower alkyl group; and A represents a divalent group which is optionally present.

17. A silver halide light-sensitive material as claimed in claim 16, wherein the tetrasubstituted thiourea is used in an amount in the range of about $1\times10^{-5}$ to $5\times10^{-2}$ mole per mole of the silver halide; and wherein the hardener is used in a proportion of 0.1 to 10 wt. % based on the weight of dried gelatin within the emulsion layer.

18. A silver halide light-sensitive material comprising a support having provided thereon at least one red-sensitive emulsion layer containing a cyan color forming coupler, at least one green-sensitive emulsion layer containing a magenta color forming coupler and at least one blue-sensitive emulsion layer containing a yellow color forming coupler; wherein at least one of the silver halide emulsion layers is hardened with a hardener containing a vinyl-sulfonyl group, the emulsion layer containing a silver halide prepared in the presence of a tetrasubstituted thiourea as a silver halide solvent, wherein said hardener has the general formula (II):

$$(CH_2{=}CH{-}SO_2{-}\underset{\underset{R}{|}}{CH}\rightarrow A$$

wherein R represents a hydrogen atom or a lower alkyl group; and A represents a divalent group which is optionally present;

said material being a color reversal light-sensitive material, wherein said material is capable of reversal processing in which a negative silver image is first formed by the treatment with a developing solution containing a black and white developing agent and then, uniform exposure or another proper fogging processing in carried out at least once and subsequently, color development is conducted to result in formation of a positive dye image.

19. A silver halide light-sensitive material as claimed in claim 18, said tetrasubstituted thiourea being $(CH_3)_2{-}N{-}C{-}S{-}N{-}(CH_3)_2$; and said hardener being 1,3-Bisvinyl-sulfonyl-2-hydroxypropane.

20. A silver halide light-sensitive material as claimed in claim 18, said tetrasubstituted thiourea being $(CH_3)_2{-}N{-}C{-}S{-}N{-}(CH_3)_2$; and said hardener being 1,2-Bis(vinylsulfonylacetamido)ethane.

21. A silver halide light-sensitive material as claimed in claim 18, said tetrasubstituted thiourea being:

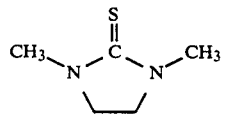

said hardener being 1,2-Bis(vinylsulfonylacetamido)ethane.

* * * * *